US005586677A

United States Patent [19]

Foos

[11] Patent Number: 5,586,677

[45] Date of Patent: Dec. 24, 1996

[54] THERMOFORMED FOLDOVER PACKAGE WITH EASY OPEN FEATURE

[75] Inventor: Douglas E. Foos, Barrington Hills, Ill.

[73] Assignee: Plastofilm Industries, Inc., Wheaton, Ill.

[21] Appl. No.: 316,240

[22] Filed: Sep. 30, 1994

[51] Int. Cl.[6] ..... B65D 43/26

[52] U.S. Cl. ..... 220/260; 220/339; 206/815

[58] Field of Search ..... 206/815, 527; 220/355, 356, 260

[56] References Cited

U.S. PATENT DOCUMENTS

| | | | |
|---|---|---|---|
| 1,603,330 | 10/1926 | Dister | 220/356 |
| 3,596,822 | 8/1971 | Holley . | |
| 4,368,819 | 1/1983 | Durham | 220/355 X |
| 4,602,719 | 7/1986 | Borst . | |
| 4,623,062 | 11/1986 | Chase et al. . | |
| 4,681,223 | 7/1987 | Roberts | 220/356 X |
| 4,807,778 | 2/1989 | Lo . | |
| 4,892,220 | 1/1990 | Foos . | |
| 4,976,370 | 12/1990 | Cassel | 220/355 X |
| 5,220,999 | 6/1993 | Goulette . | |

*Primary Examiner*—Jacob K. Ackun
*Attorney, Agent, or Firm*—Welsh & Katz, Ltd.

[57] ABSTRACT

A foldover container which is uniquely constructed so that the container may be easily opened and closed. The container has a base with a sidewall circumscribing a top opening. An outward extending flange for grasping the base is attached to the sidewall. A cover is hingeably connected to the base and has a peripheral downward extending skirt with a flange extending generally outward from the skirt. The cover is shaped and dimensioned to cover and close the top opening with the skirt extending generally along the exterior of the sidewall of the base.

When the cover closes the top opening, the cover and base may be releasably attached to hold the cover in the closed position, and the skirt and the sidewall are sized so that the flange on the base is vertically spaced from the flange on the cover so that each of the flanges may be individually and pinchingly grasped to open the container.

5 Claims, 1 Drawing Sheet

THERMOFORMED FOLDOVER PACKAGE WITH EASY OPEN FEATURE

BACKGROUND OF THE INVENTION

The present invention relates generally to disposable plastic container of products and specifically to foldover packages having upper covers which engage lower bodies thereby providing a container for the storage of articles and other items.

Many times a variety of products are packaged in recloseable plastic containers. As these containers may contain a larger number of articles than which are typically used on a single occasion, these containers may also function as storage containers to store the articles between use. In addition, the number of articles contained may exceed several occasions of use such that the container is repeatedly reopened and then closed. Thus, the ease by which the container may be reopened becomes important in the marketing of the articles to the consumer.

One of the more typical plastic containers intended to hold merchandise has a bottom portion or base and a top lid or cover attached to the base by a hinge. Although, rectangular packages are very common, the base and cover may have a variety of configurations including polygonal, round, oblong etc. To hold the cover to the base when the cover is closed, it is very common to provide some means for interlocking the cover and base. For example, a snap fit interlock may be provided. These interlocking structures hold the cover and base together during normal handling, but allow the cover and base to be parted when sufficient force pulling them apart is exerted.

For many containers having a interlock such as a snap-fit closure, it may be difficult or inconvenient for the user to reopen the container by grabbing the two halves and pulling them apart. For example, the base and cover may not be formed so as to be readily grasped by the hands of the user; the base and cover may be too large, too small, too slippery or in a shape that is difficult to hold. Consequently, many of the presently available recloseable containers have some feature formed on them specifically intended to aide the user in reopening the container. For example, it is common for containers to provided with flanges which extend outwardly from the peripheries of the base and cover portions. Usually, the flanges are formed so as to be adjacent to one another, but do not entirely overlap. The user may then locate those areas where the flanges do not overlap so that one flange of the cover may be grasped separately from the flange of the base. The individual flanges are then pulled away from each other to separate the cover and base. However, the locations where the flanges do not overlap may be difficult to locate, particularly when the container is formed by clear plastic.

In addition, many containers have the snap fit interlocks at several positions and due to the flexibility of the container, the non-overlapping flange portions need to be located in close proximity to the snap fit interlocks. To singularly disengage these snap fit interlocks, the non-overlapping flange portions must be individually located.

It is therefore an object of the present invention to provide an improved recloseable container. A related object is to provide such a container which may be easily and repeatedly reopened.

An additional object of the present invention is to provide an improved recloseable container having a snap fit interlocking structure for releasably retaining the cover to a base of the container which facilitates the individual grasping of the cover and base to reopen the container.

A further object of the present invention is to provide an improved recloseable container having outwardly extending flanges on a top and base of the container and particularly adapted so that the flanges may be individually grasped to reopen the container. A related object is to provide such a container which does not solely rely on the provision of non-overlapping flange sections to allow the flanges to be individually grasped.

SUMMARY OF THE INVENTION

In keeping with one aspect of this invention, a foldover container is disclosed which is uniquely constructed so that the container may be easily opened and closed. The container has a base with a sidewall circumscribing a top opening. An outward extending flange for grasping the base is attached to the sidewall. A cover is hingeably connected to the base and has a peripheral downward extending skirt with a flange extending generally outward from the skirt. The cover is shaped and dimensioned to cover and close the top opening with the skirt extending generally along the exterior of the sidewall of the base.

When the cover closes the top opening, the cover and base may be releasably attached to hold the cover in the closed position, and the skirt and the sidewall are sized so that the flange on the base is vertically spaced from the flange on the cover so that each of the flanges may be individually and pinchingly grasped to open the container.

More particularly, the base may form an upper rim defining the top opening and the sidewall forms at least a portion of the rim. The flange extends outward from a lower end of the sidewall. The cover is dimensioned so that the cover may be pivoted to close the top opening with the rim abutingly contacting a peripheral edge to which the skirt is attached When the cover is closed over the top opening, the skirt and the sidewall are sized so that the flange on the base is vertically spaced from the flange on the cover so that each of the flanges may be individually grasped to open the container.

DESCRIPTION OF THE PREFERRED EMBODIMENTS

Figure 1:
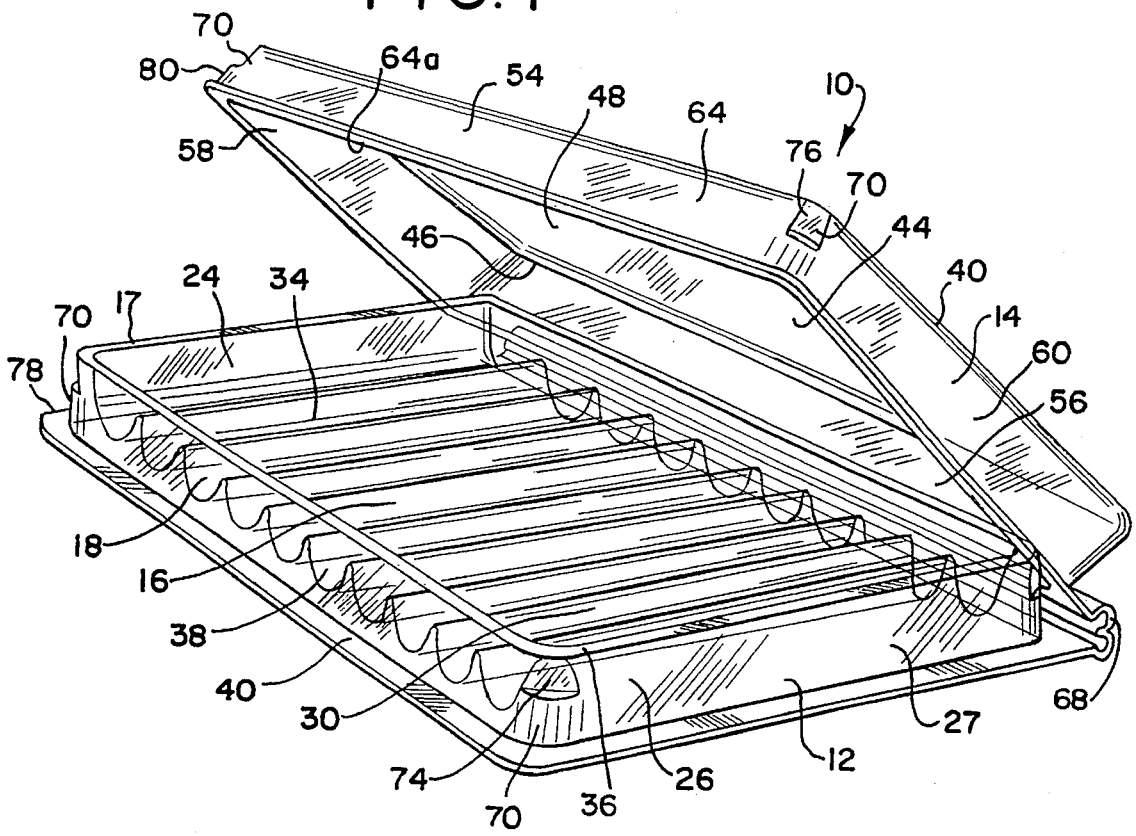
FIG. 1 is a perspective view of the a recloseable container of the present invention shown in a partially open position.
Figure 2:
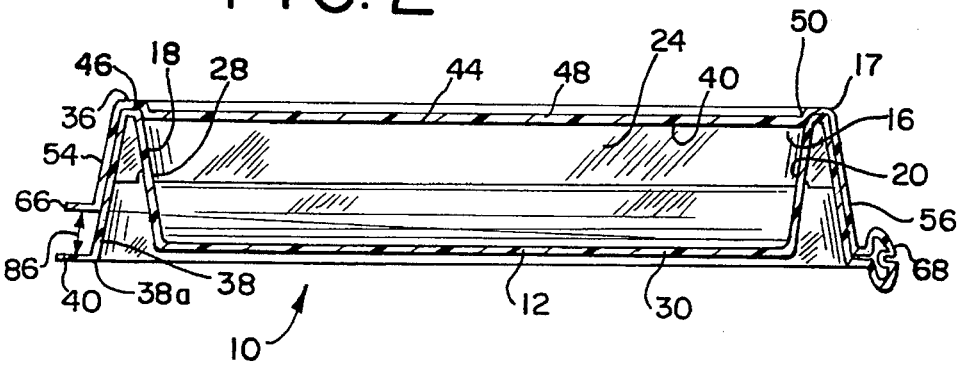
FIG. 2 is a cross sectional view of the container of FIG. 1 in the closed position taken generally across the width of the container.

Referring now to FIGS. 1 and 2, a container is generally designated 10 and is preferably made of an inexpensive, yet durable grade of plastic. The exact type of plastic to be used may be varied depending on the articles which are contained within the container. One type of plastic which is specially suitable to the present container is high density polyethylene (HDPE). In addition, the container shown is transparent; however, the container may also be opaque, translucent, etc. The container 10 may be produced by thermoforming a suitable plastic film. Alternately, the present container 10 may also be conceivably manufactured by blow molding or injection molding.

The container 10 is shown, for illustrative purposes, as having a substantially rectangular shaped base 12 and a rectangularly shaped cover 14 which fits over and closes top opening 16 defined by a rim 17 formed by the base. Although the base 12 and cover 14 may have any desired configuration, for example, round, oblong, or polygonal, etc., the rectangular configuration shown in FIG. 1 is particularly common. In this configuration, the base 12 has a front sidewall 18, a rear sidewall 20 and first and second sidewalls 24, 26. The sidewalls 18, 20, 24 and 26 are integrally joined to each other to form a peripheral sidewall 27 and the generally horizontally extending upper rim 17 of the base which defines the top opening 16.

Each of the sidewalls 18–26 is preferably formed with an inner wall 28 integrally connected to and depending downward from the rim 17. The lower edges of the inner wall 28 are integrally joined by a floor 30. The floor 30 may be particularly formed to retain articles contained within the container. In the particular example shown, the floor 30 is formed into a number of transversely extending bins 34. Each of the bins 34 is sized to retain individual articles (not shown).

The upper rim 17 includes a generally horizontal peripheral ledge 36 which is integrally attached to a downwardly depending peripheral outer wall 38. The outer wall 38 preferably forms a portion of the front sidewall 18; however, in the preferred embodiment, the outer wall forms a portion of all four sidewalls 18, 20, 24 and 26. A horizontal, outwardly projecting flange 40 extends from a lower edge **38*a* of the outer wall 38 along at least a portion of the sidewalls 18, 20, 24 and 26 and preferably all of the sidewalls. The outer wall 38 and the inner wall 28 should be formed, with a slight draft, in the vertical direction to facilitate the stacking of multiple containers 10** for shipment and storage.

The cover 14 includes a top 44 having a peripheral edge portion 46 which is slightly elevated relative to a center portion 48 for strength purposes. The center portion 48 is joined to peripheral edge 46 by short wall 50. The cover 14 also includes front, rear and first and second skirts, respectively designated 54, 56, 58 and 60 which correspond to the front, rear and first and second sidewalls 18, 20, 24 and 26, respectively. The skirts 54–60 are integrally connected to and downwardly depend from the peripheral edge 46.

The front, rear and side skirts 54–60 are integrally joined to each other to form a peripheral skirt 64 of the cover 14. At least one of the skirts 54–60 is configured to abuttingly envelop at least a portion of the outer wall 38 portion of at least one of the outer sidewalls 18–26 of the base 12 when the container 10 is closed, as shown in FIG. 2. In the preferred embodiment, the skirts 54–60 envelop at least portions of the outer wall 38 of the corresponding sidewalls 18–26 around all of the periphery of the base 12. A horizontal, outwardly projecting flange 66 is attached to and extends from a lower edge **64*a* of at least a portion of one of the skirts 54–60** and preferably the flange extends outward along the entire length of all of the skirts.

A hinge 68 is preferably disposed at the rear skirt 56 of the cover 14 and the rear sidewall 20 of the base 12 for securing the cover to the base. It is contemplated that the hinge 68 may also be located along other walls of the container 10. Also in the preferred embodiment, the hinge 68 is integral to both the cover 14 and base 12 and is shown provided with a deadfold living hinge; however, it is contemplated that other types of hinges, such as other types of living hinges as well known in the art, may also be suitably employed. The hinge 68 is formed to integrally connect the flange 40 of the base 12 to the flange 66 of the cover 14.

Interlocking formations 70 are formed on the base 12 and cover 14 to releasably hold the cover in the closed position upon the base 12 when the cover is closed over the top opening 16. In the preferred embodiment, the interlocking formations comprise backdrafted corner snaps 74 formed in the base 12 and similarly configured backdrafted corner snaps 76 formed in the cover 14. These corner snaps 74 and 76 may also serve as denesting lugs when multiple containers 10 are nestingly stacked together.

As is well known in the art, the closing of the cover 14 upon the base 12 causes the corner snaps 76 in the cover to fit within the corner snaps 74 in the base to hold the cover in position. Opposing vertical forces applied to the cover 14 and base 12 will typically cause the corner snaps 76 to disengage from the corner snaps 74 to allow the reopening of the container 10. One of the corner snaps 74 is preferably formed along the junctures 78 between the first and second sidewalls 24, 26 and front sidewall 18 of the base and one of the corner snaps 76 is formed to be aligned with the corner snaps 74 by being formed in the junctures 80 between the side skirts 58, 60 and front skirt 54 of the cover 14.

Referring particularly to FIG. 2, the easy opening feature of the preferred embodiment is formed by configuring the cover 14 and base 12 so that when the cover is releasably held to the base, the flange 66 is spaced from flange 40 so that each of the flanges may be individually grasped to part the cover 14 from the base 12. Preferably, when the cover 14 is releasably held to the base 12, the peripheral edge portion 46 of the cover fits over and abutingly contacts the upper rim 17 of the base 12. Also, the front skirt 54 downwardly extends along or envelops only a portion of the generally vertical length of the outer wall 38 of the front sidewall 18. Thus, the lower edge **54*a* of the front skirt 54 and flange 66 of the cover 14 is vertically separated from the lower edge 38*a* of the outer wall 38 and flange 40 of the base 12, when the cover 14 is held to the base by the interlocking formations 70. The vertical separation should be sufficient to allow fingers to be easily inserted between flange 40 and flange 66** so that each flange may be individually and pinchingly grasped.

Also, in the preferred embodiment, the rear skirt 56 of the cover 14 is sized to downwardly depend along the outer wall 38 of the rear sidewall 20 such that flange 40 and flange 56 are abuttingly adjacent each other. Thus, the hinge 68 may be easily formed to connect the cover to the base 12. Furthermore, it can be seen that when the container 10 is closed, the flanges 66 extending along the first and second side skirts 58, 60 of the cover 14 are angled so as to be vertically separated from the flanges 40 extending along the first and second sidewalls 24, 26 of the base 12 adjacent the front sidewall 18 but are abutingly adjacent those flanges 40 adjacent the rear sidewall 56.

In operation, the entire container 10 is manufactured as an unitary, integral unit preferably in a thermoforming operation. The supply of articles is placed within the base 12 and along the floor 30. The cover 14 is then rotated about the hinge 68 to cover the top 16 with the interlocking formations 70 releasably holding the cover in position upon the base 12. The entire container 10 may then be sealed with a clear plastic wrap, for shipment and purchase.

Upon removal of the seal, (not shown), the container 10 is opened by individually and pinchingly grasping the flange 66 of the cover 14 and flange 40 of the base 12. The grasping preferably occurs along the front sidewall 18 of the base and front skirt 54 of the cover 14, where the separation distance between flange 66 and flange 40 is greatest. The application of opposing directed forces, designated by arrow 86 causes the interlocking formation 70 to disengage from each other allowing the cover 14 to be pivoted about the hinge 68 to open the top 16 of the base 12.

A specific embodiment of the novel thermoformed foldover package with easy open feature according to the present invention has been described for the purposes of illustrating the manner in which the invention may be made and used. It should be understood that implementation of other variations, and modifications of the invention in its various aspects will be apparent to those skilled the art, and that the invention is not limited by the specific embodiment described. It is therefore contemplated to cover by the present invention any and all modifications, variations, or equivalents that fall within the true spirit and scope of the basic underlying principles disclosed and claimed herein.

What is claimed is:

1. A container comprising:

a base having an upper rim defining a top opening and a sidewall forming at least a portion of said rim, said base including a first flange extending outward from said sidewall along one length of the sidewall and a second flange extending outward from said sidewall along a second length of the sidewall;

a cover hingeably connected to said base, said cover including a peripheral portion and a skirt connected to said peripheral portion, said cover being shaped and dimensioned to cover and close said top opening of said base with said skirt extending generally along the exterior of said sidewall, said cover including a third flange extending outward from said skirt along a first length of said skirt and a fourth flange extending outward from said skirt along a second length of said skirt;

a hinge integrally and pivotally connecting said second flange to said fourth flange; and means for releasably holding said cover in position upon said base when said cover is closed over said top opening, said skirt and said sidewall being sized so that said first flange is vertically spaced from said third flange and said second flange extends abuttingly adjacent said fourth flange when said cover is closed so each of said first and said third flanges may be individually grasped to open said container.

2. The container of claim 1 wherein said hinge is disposed along a first side of said base and said cover and said first flange is spaced from said third flange along a second side of said base, said first side being opposite said second side.

3. The container of claim 2 wherein said holding means is disposed in close proximity to said second side.

4. The container of claim 2 wherein said cover and said base are generally rectangular and said first flange and said third flange extend along the length of said second side, said second flange and said fourth flange extend along the length of said first side, said cover includes first side flanges extending outward from said sidewall, said first side flanges extending from and connected to said third flange and said fourth flange, said base including second side flanges extending outward from said sidewall, said second side flanges connected to and extending from said first flange to said third flange, said skirt and said sidewall being sized so that when said cover is closed, said first side flanges are vertically spaced from said second side flanges adjacent said second side and said second side flanges being disposed abuttingly adjacent said first side flanges adjacent said first side.

5. The container of claim 1 wherein said holding means being only disposed along said second side.

* * * * *